US011212610B2

(12) United States Patent
Sha

(10) Patent No.: US 11,212,610 B2
(45) Date of Patent: Dec. 28, 2021

(54) HEARING DEVICE

(71) Applicant: BOCO INC., Tokyo (JP)

(72) Inventor: Hataaki Sha, Tokyo (JP)

(73) Assignee: BOCO INC., Tokyo (JP)

( * ) Notice: Subject to any disclaimer, the term of this patent is extended or adjusted under 35 U.S.C. 154(b) by 0 days.

(21) Appl. No.: 16/963,743

(22) PCT Filed: Jun. 1, 2018

(86) PCT No.: PCT/JP2018/021175
§ 371 (c)(1),
(2) Date: Jul. 21, 2020

(87) PCT Pub. No.: WO2019/146138
PCT Pub. Date: Aug. 1, 2019

(65) Prior Publication Data

US 2021/0099789 A1 Apr. 1, 2021

(30) Foreign Application Priority Data

Jan. 24, 2018 (JP) ..... JP2018-009561

(51) Int. Cl.
*H04R 1/00* (2006.01)
*H04R 1/10* (2006.01)

(52) U.S. Cl.
CPC ..... *H04R 1/1091* (2013.01); *H04R 2460/13* (2013.01)

(58) Field of Classification Search
CPC ..... H04R 25/606; H04R 2460/13; H04R 1/1091; H04R 25/456; H04R 25/65; H04R 2225/63
See application file for complete search history.

(56) References Cited

U.S. PATENT DOCUMENTS 9,554,223 B2 * 1/2017 Hillbratt ..... H04R 25/456
2002/0183014 A1 12/2002 Takeda et al.
2008/0267433 A1 10/2008 Katou et al.
2012/0237075 A1 9/2012 East et al.
(Continued)

FOREIGN PATENT DOCUMENTS

JP H0262199 A 3/1990
JP 2002-359889 A 12/2002
JP 2005-328125 A 11/2005
(Continued)

OTHER PUBLICATIONS

International Search Report issued in PCT Patent Application No. PCT/JP2018/021175 dated Jul. 17, 2018.
(Continued)

*Primary Examiner* — Amir H Etesam
(74) *Attorney, Agent, or Firm* — Marshall, Gerstein & Borun LLP

(57) ABSTRACT

A hearing device is characterized by being provided with: a bone conduction drive that converts acoustic electric signals to vibrations; a housing that contains the bone conduction drive; a vibration output structure that is provided in the housing and that outputs the vibrations converted by the bone conduction drive; and an ear-hanging member provided to the housing, wherein one of a plurality of the vibration output structures which have different shapes is provided to the housing.

16 Claims, 12 Drawing Sheets

(56) References Cited

U.S. PATENT DOCUMENTS

2014/0355792 A1 12/2014 Nabata et al.

FOREIGN PATENT DOCUMENTS

| | | | |
|---|---|---|---|
| JP | 2005328118 | A | 11/2005 |
| JP | 2007-72015 | A | 3/2007 |
| JP | 2007-505540 | A | 3/2007 |
| JP | 3144392 | U | 8/2008 |
| JP | 2009094986 | A | 4/2009 |
| JP | 2010-528547 | A | 8/2010 |
| JP | 2012-105118 | A | 5/2012 |
| JP | 2013-115801 | A | 6/2013 |
| JP | 2013-229796 | A | 11/2013 |
| WO | WO-02/30151 | A2 | 4/2002 |
| WO | WO-2006/080517 | A1 | 8/2006 |
| WO | WO-2008-004273 | A1 | 1/2008 |

OTHER PUBLICATIONS

Notice of Reasons for Refusal issued in Japanese Patent Application No. 2018-009561 dated Nov. 1, 2018.
Notice of Reasons for Refusal issued in Japanese Patent Application No. 2016-233716 dated Apr. 28, 2017.

* cited by examiner

[illustration of a prior art]

HEARING DEVICE

TECHNICAL FIELD OF THE INVENTION

The present invention relates to a hearing device employing bone conduction that enables a hearer to perceive sound by conducting vibrations to bones, and more particularly to a hearing device that enables a wearer to wear without caring about its fitting position to hear sounds properly.

BACKGROUND OF THE INVENTION

As a means of listening to music or sounds of radio and television, or a means for conversations over mobile phones or wireless devices, devices such as headphones and earphones worn over or in ears for listening sounds and music (hereinafter, hearing devices) have been widely used conventionally. For example, headphones, which are commonly used hearing devices, are worn by being plugged into earholes or by covering entire ears. Such headphones use a mechanism in which a sound source that is input as electric signals is converted into air vibrations that are then transmitted to and vibrate an eardrum, and the vibrations of the eardrum travel inside the ear through a middle ear so that information of the sound is transmitted to and perceived by a brain.

However, instead of the mechanism in which air vibrations vibrate a user's eardrum as above, hearing devices employing bone conduction in which sound vibrations are conducted to the user's skull so that sounds can be recognized by vibrations of bones have been developed in recent years. Unlike headphones and earphones, the user does not have to insert such a bone conduction hearing device into his/her earhole. Thus, it is safer for the user since he/she can hear unblocked surrounding sound while wearing the device. Also, since bone conduction does not use eardrum vibrations, even people with hearing difficulties would be able to perceive sounds through bone conduction. Thus, hearing aids and the like employing bone conduction have been advanced.

Such a hearing device employing bone conduction converts acoustic signals that are input as electric signals into mechanical vibrations and conducts these vibrations from an appropriate position to bones so that the hearer can perceive the sound as bone-conducted sound through vibrations. Examples of the appropriate position are parts like areas around temples, or mastoid process which is a large protrusion at the lower back part of the temporal bone.

The area around temples, in other words, is the skull itself. If a vibrating part comes into contact with the temples area properly, sound vibrations can be transmitted to the bones accurately. Thus, hearing devices employing bone conduction, especially headphone types, widely adopt such temple-contacting method.

In addition, it is important for such type of hearing device employing bone conduction to make sure that the vibrating part is in contact with the temples area with accuracy. Thus, such hearing device is in an arm shape so that the device can be used hanging over an upper part of the ear.

On the other hand, as a device that conducts vibrations to the mastoid process instead of the temples area, Japanese Unexamined Patent Application Publication No. 1990-62199 (JP-A-1990-62199) titled "Bone conduction type sound hearing device and a method for the same" discloses a structure in which a speaker as a bone conduction means is disposed inside a substantially C-shaped housing so as to cover most of the mastoid process of a hearer (see FIG. 11).

The above structures that conduct vibrations either to the temples area or the mastoid process can be worn without blocking the ears, and thus, as mentioned above, it is safer for the user since he/she can hear unblocked surrounding sound while wearing the device and people with hearing difficulties would be able to perceive sounds.

As mentioned above, a hearing device employing bone conduction enables hearing of sounds by contacting its vibrating part at an appropriate position. To transmit vibrations from the vibrating part that is in contact with the appropriate position to the bones, it is necessary to apply a certain amount of contacting pressure, and thus tightening is required. This is because, if the tightening is weak and the vibrating part is merely touching the bones, the vibrations will not transmit properly and a user will find it difficult to perceive sounds.

For this reason, for the hearing device employing bone conduction with the vibrating part to be in contact with the temples area as above, it is necessary to design its structure so that the vibrating part comes into contact with the temples area with pinpoint accuracy by applying pressure firmly and to make sure that the vibrating part is disposed at the appropriate position around the temple when fitted.

Also, if the vibrating part is shifted from the appropriate position due to unstable fitting, adjustment is needed to set the vibration part back to the appropriate position again.

On the other hand, FIG. 11 is a view illustrating a prior art, showing a structure disclosed in Patent Document 1 in which a vibrating part is disposed so as to cover the mastoid process. This structure is designed so that a bone conduction speaker b disposed inside a substantially C shaped housing a can be worn applying pressure around the mastoid process. Thus, when wearing this device, it is necessary to pay attention that the speaker b is disposed at an appropriate position around the mastoid process with pinpoint accuracy.

Since a position of the mastoid process varies from person to person, adjustment for disposing and contacting position of the vibration part is necessary. Thus, it is required to manufacture and prepare various types of devices with different sizes to fit physical features of the users, and this sometimes requires full customer-made production for particular use. This problem inhibits the spread of sound recognition devices employing bone conduction.

Meanwhile, hearing devices employing bone conduction has been used conventionally to help people with hearing difficulties who have issues with their eardrums where it is difficult to hear sounds when sound source is input as electric signals and is converted into air vibrations and transmitted to and vibrates the eardrums.

However, in recent years, since they do not block earholes and they are safer for the user because he/she can hear unblocked surrounding sound, the hearing devices employing bone conduction have been attracting attention and used in devices such as mobile phones, and their use by people with healthy auditory sensation is on the increase.

However, for a person with healthy auditory sensation, when sound is transmitted by bone conduction, the sound coming in from the earhole is transmitted to the eardrum at the same time. Thus, if there is noise around, the noise entering into the earhole is mixed with the sound from the bone conduction, and the sound from bone conduction is masked, which makes it harder to hear.

To deal with such problem, the user might wear earplugs or insert his/her fingers into the earholes. This spoils the purpose of employing bone conduction.

SUMMARY OF THE INVENTION

To solve the above-mentioned problems, the present invention provides a hearing device employing bone conduction that allows not only people with hearing difficulties but also people with healthy auditory sensation to wear easily and simply and to hear sounds properly through bone conduction.

To achieve the above object, the inventor of the present application has invented following devices after earnest research:

A hearing device including a bone conduction drive that converts acoustic electric signals into vibrations, a vibration output structure that outputs the vibrations converted by the bone conduction drive, and an ear-hanging member that is provided above a housing accommodating the bone conduction drive and is hanged on an upper part of an auricle so as to dispose the vibration output structure between a back part of the auricle and a temporal region, wherein the vibration output structure is disposed between the back part of the auricle and the temporal region and has a length that comes into contact with an area ranging from an upper part to a lower part of the back of the auricle;

A hearing device including a bone conduction drive that converts acoustic electric signals into vibrations, a housing that accommodates the bone conduction drive, a vibration output structure that outputs the vibrations converted by the bone conduction drive, the vibration output structure being provided to the housing detachably, and an ear-hanging member provided to the housing.

The present invention is not limited to the embodiments described above or to embodiments described in detailed descriptions below. Needless to say, various examples of changes or modifications within the scope of the technical idea of the present invention are possible.

(1) The hearing device according to the present invention includes a bone conduction drive that converts acoustic electric signals into vibrations, a vibration output structure that outputs the vibrations converted by the bone conduction drive, and an ear-hanging member that is provided above a housing accommodating the bone conduction drive and is hanged on an upper part of an auricle so as to dispose the vibration output structure between a back part of the auricle and a temporal region, wherein the vibration output structure is disposed between the back part of the auricle and the temporal region and has a length that comes into contact with an area ranging from an upper part to a lower part of the back of the auricle. Thus, anybody who has healthy auditory sensation or hearing difficulties, regardless of his/her physical features, can wear the hearing device easily and simply without caring about its fitting position and can hear the sounds properly.

Also, a user can wear the hearing device only by placing the device between the back part of the auricle and the temporal region, and thus the user does not receive stress due to tightening nor experience shifting of the device from slight movements. Moreover, the hearing device is small-sized and lightweight with good design, easy to wear or remove, and comfortable to wear.

Furthermore, since vibrations from the vibration output structure transmits from the temporal region to the skull and also from the back part of the auricle to the entire auricle vibrating air around the auricle, the user can hear the sounds by bone conduction from the bones and the sounds by air vibrations from the earhole at the same time so that the user can hear the sounds clearly.

Also, the hearing device according to the present invention employs bone conduction and does not block earholes, and therefore has high safety. Thus, the hearing device can be used for devices in various fields, such as in headphone mikes, hearing aids, and helmets that enable conversations in noisy locations.

(2) Also, the hearing device according to the present invention includes a bone conduction drive that converts acoustic electric signals into vibrations, a housing that accommodates the bone conduction drive, a vibration output structure that outputs the vibrations converted by the bone conduction drive, the vibration output structure being provided to the housing detachably, and an ear-hanging member provided to the housing. Thus, anybody who has healthy auditory sensation or hearing difficulties, regardless of his/her physical features, can wear the hearing device easily and simply without caring about its fitting position and can hear the sounds properly. In particular, the vibration output structure that is most suitable for the user's age, sex, the shape of his/her head and ears can be chosen appropriately and attached to the housing.

DESCRIPTION OF SOME EMBODIMENTS

Hereinafter, some embodiments of a hearing device employing bone conduction according to the present invention will be described in detail with reference to the accompanying drawings of embodiments.

Figure 1:
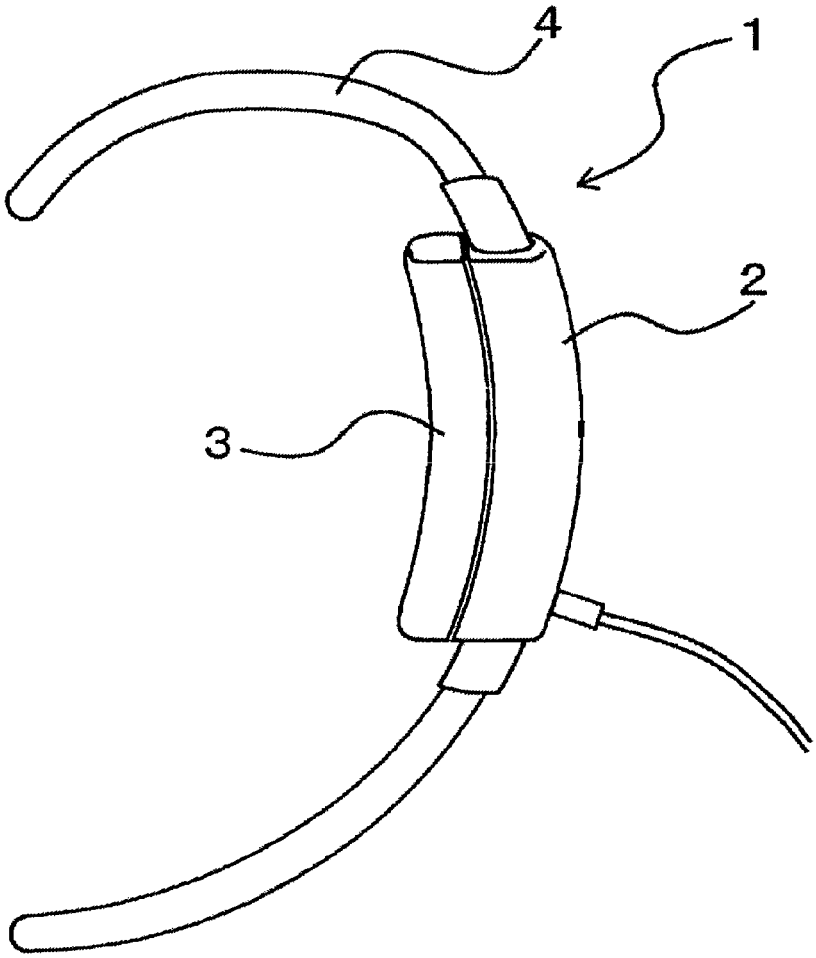
FIG. 1 is an external appearance view illustrating a working example of a hearing device according to the present invention.
Figure 2:
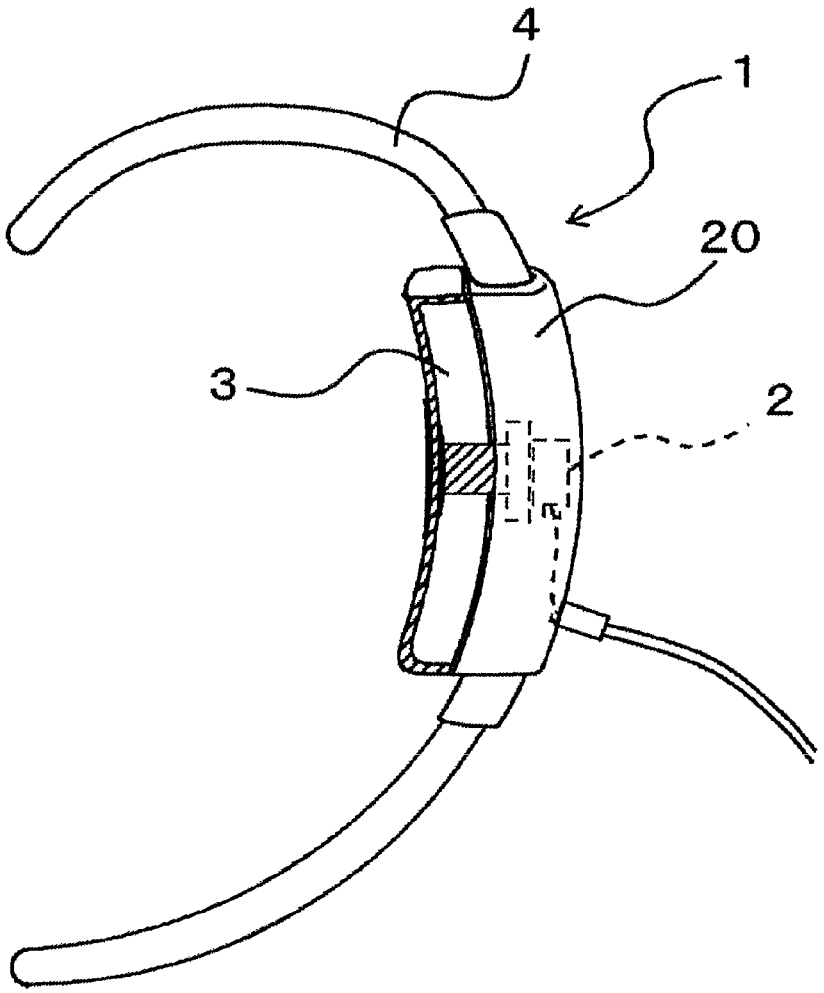
FIG. 2 is a partial cross sectional view illustrating the working example of the hearing device according to the present invention.

FIG. 1 is an external appearance view illustrating a working example of a hearing device according to the present invention, and FIG. 2 is a partial cross sectional view illustrating the working example of the hearing device according to the present invention. FIG. 1 and FIG. 2 show a hearing device 1, a bone conduction drive 2, a vibration output structure 3, an ear-hanging member 4, and a housing 20.

Working Example 1

In the working example of the hearing device according to the present invention shown in FIGS. 1 and 2, the hearing device 1 includes the bone conduction drive 2, the vibration output structure 3, and the ear-hanging member 4.

The bone conduction drive 2 converts acoustic electric signals into vibrations, and the vibration output structure 3 outputs the vibrations converted and transmitted by the bone conduction drive 2.

Converting acoustic electric signals into vibrations means converting acoustic electric signals that are input externally into mechanical vibrations: the bone conduction drive 2 vibrates a diaphragm or the like by the acoustic electric signals and converts the acoustic electric signals into mechanical vibrations that are then transmitted to bones.

In the present invention, a type of vibrating system of the bone conduction drive 2 is not particularly limited as long as the acoustic electric signals can be converted into mechanical vibrations, and any types of conventional methods such as piezoelectric, electromagnetic, or super-magnetostrictive methods are applicable.

The bone conduction drive 2 is accommodated in the housing 20 and the ear-hanging member 4 is provided above the housing 20.

The housing 20 accommodates and fixes the bone conduction drive 2, and a signal cable that inputs external acoustic electric signals into the bone conduction drive 2 is also provided. The vibrations converted by the bone conduction drive 2 accommodated and fixed in the housing 20 vibrate the entire vibration output structure 3 connected to the bone conduction drive 2, which are then transmitted to a wearer.

The vibration output structure 3 according to the present invention is disposed between a back of an auricle and a temporal region and is formed to have a length that comes into contact with an area ranging from an upper part to a lower part of the back of the auricle.

It is considered that this structure enables the wearer to clearly hear the sounds from the hearing device 1 for the following reasons.

That is, the vibration output structure 3 transmits the vibrations from the bone conduction drive 2 from the back part of the auricle to the entire auricle and from the temporal region to the skull. This structure enables the wearer to receive the vibrations over a wide area from two sides, i.e. the back part of the auricle and the skull of the temporal region, and hear the sounds.

In addition, while the vibrations from the temporal region conducts sound vibrations to the skull and conduct sounds through bone vibrations, the vibrations from the back part of the auricle transmit to the entire auricle and a part of the vibrations vibrate skin tissue of an earhole, which then transmitted to the air around the earhole and the vibrations transmitted to the air reach an eardrum to conduct sounds.

Thus, it is considered that, when hearing the sounds, since the wearer can hear the sounds from bone conduction and the sounds transmitted to the eardrum by air vibrations at the same time, the noise entering into the earhole and the sounds from bone conduction are not mixed, the sounds from bone conduction is not masked by the noise entering the earhole, and the wearer can hear the sounds clearly.

Since the vibration output structure 3 directly touches the skin of the wearer, the vibration output structure 3 is made of a material that is not painful or uncomfortable when fitted. Examples are synthetic resin and synthetic rubber, and, although not limited to the above, the material is preferably soft and flexible since the vibration output structure 3 is disposed between the back of the auricle and the temporal region and comes into contact with the area ranging from the upper part to the lower part of the back of the auricle.

Also, the ear-hanging member 4 is formed to be hanged on an upper part of the auricle so that the vibration output structure 3 is disposed between the back part of the auricle and the temporal region. Shapes or materials of the ear-hanging member 4 are not limited as long as the vibration output structure 3 can be disposed at an appropriate position when the hearing device 1 is worn. For the hearing device 1 according to the present invention, it is not particularly necessary to transmit vibrations to a specific position such as area around the mastoid process or the temples, and thus the appropriate position is a part between the back of the auricle and the temporal region. Thus, as long as the hearing device 1 can be disposed at the said position, the ear-hanging member 4 may be not only in a hook shape hanged on the upper part of the ear as shown in FIGS. 1 and 2 but also in a form in which, although drawings thereof are omitted, the housing 20 is disposed at each end of a neckband or a headband that are used in common headphones.

Furthermore, the ear-hanging member 4 may be formed detachable from the housing 20 and replaced with the ear-hanging member 4 of a suitable size, depending on the shape of the ear.

Needless to say, the hearing device 1 according to the present invention can be used by fitting into one ear or to both ears.

Also, the hearing device 1 according to the present invention can serve as a microphone by attaching a mike, or may be used as a hearing aid by attaching a sound collector, and can be used in various devices and equipment employing bone conduction.

Figure 3A:
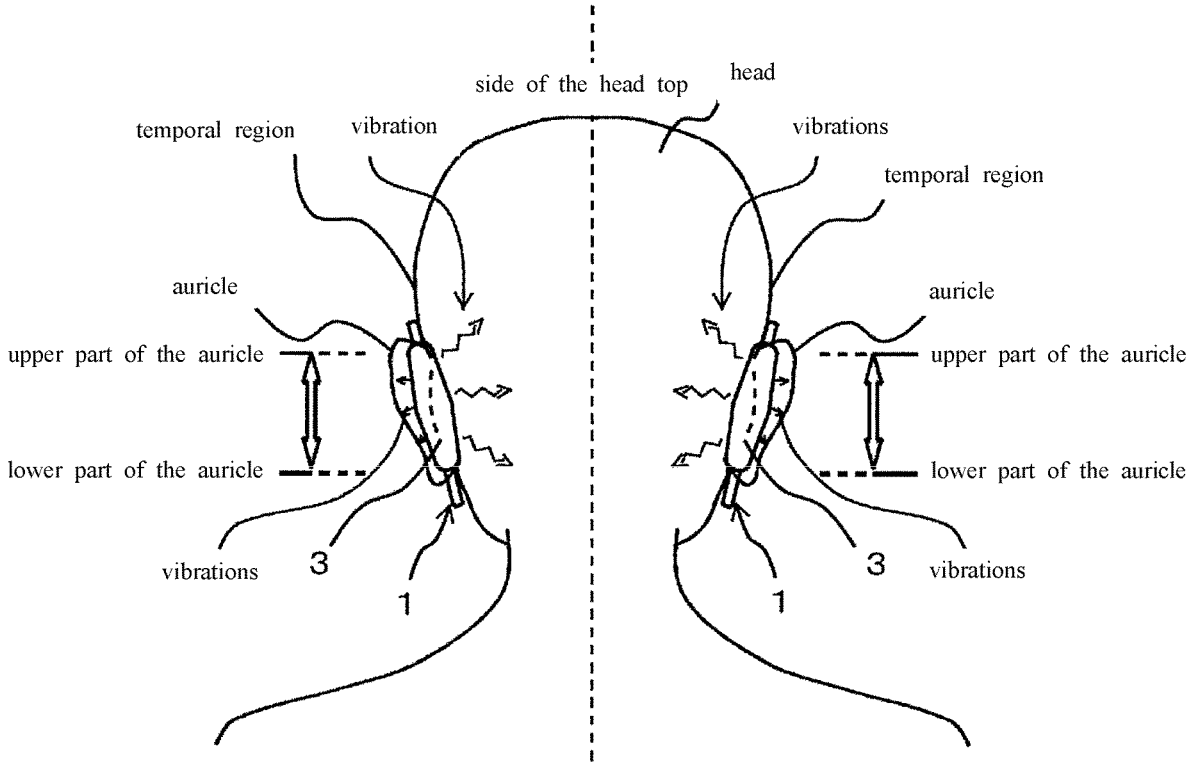
FIG. 3A is a detailed view illustrating a state of wearing the working example of the hearing device according to the present invention.
Figure 3B:
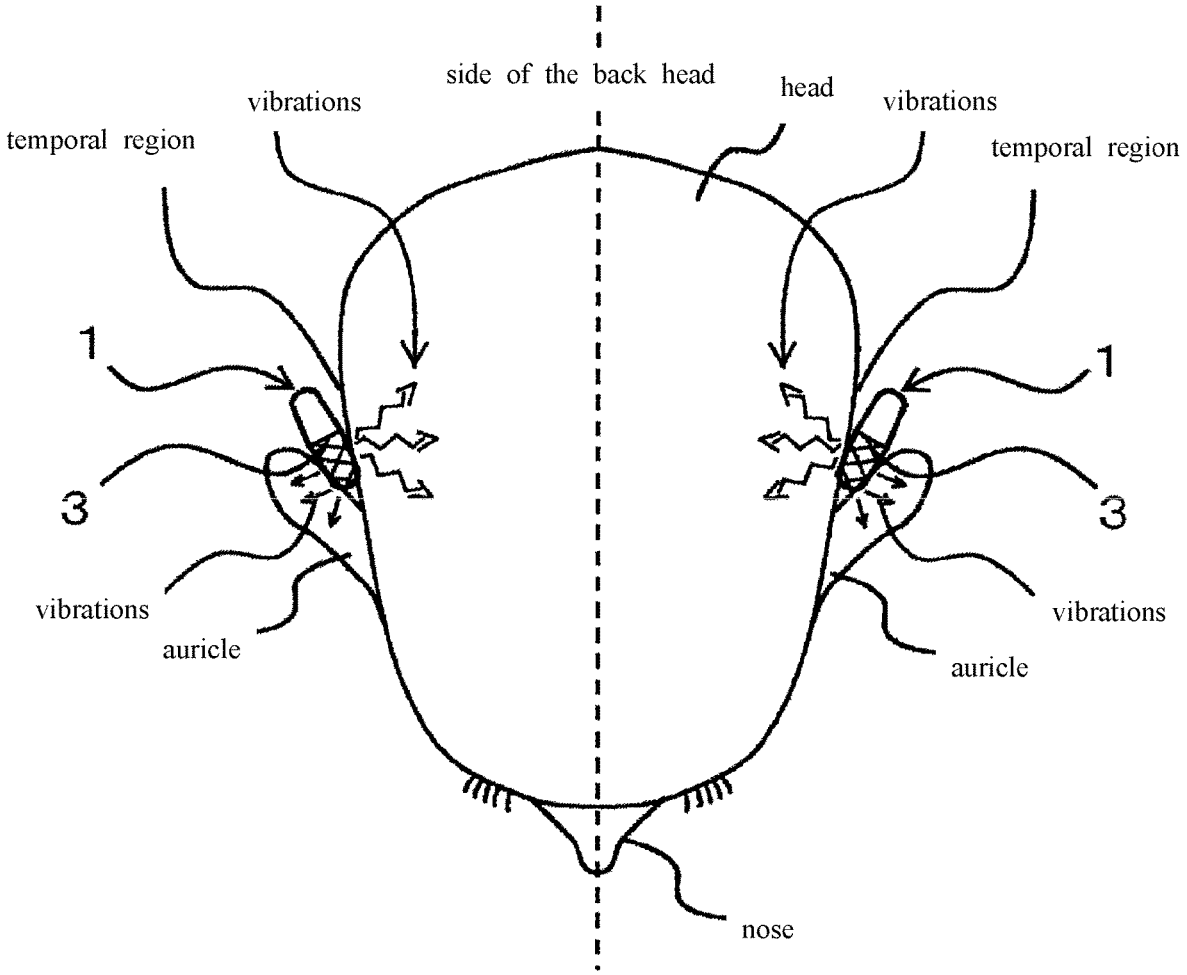
FIG. 3B is a detailed view illustrating a state of wearing the working example of the hearing device according to the present invention.
Figure 4:
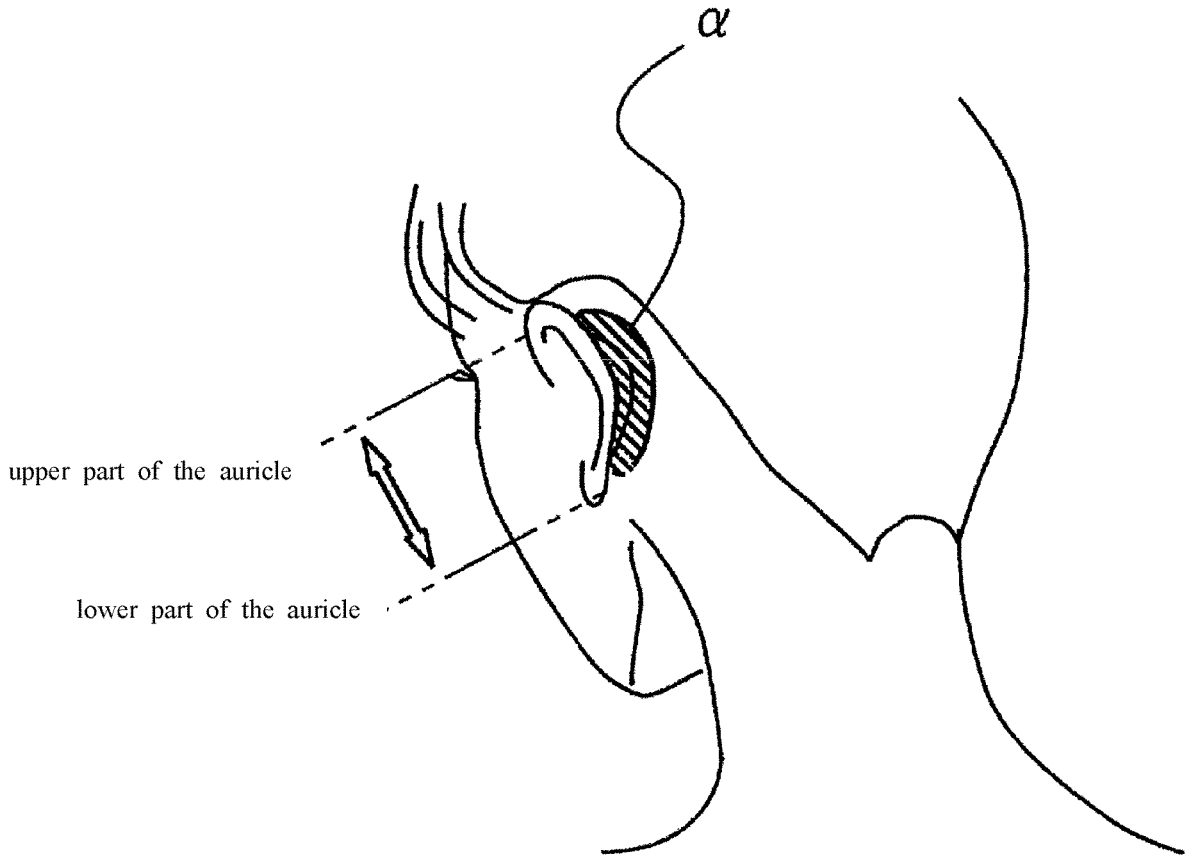
FIG. 4 is a view illustrating a fitting position for the working example of the hearing device according to the present invention.
Figure 5:
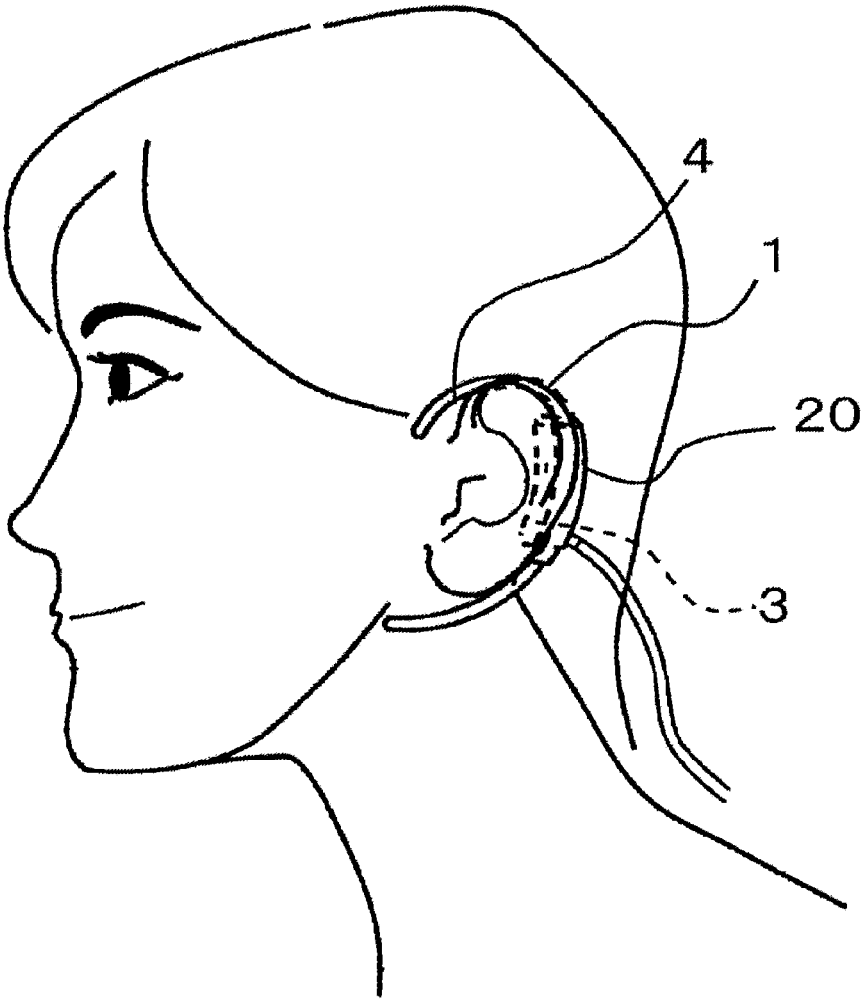
FIG. 5 is a view illustrating an example of wearing the working example of the hearing device according to the present invention.

Fitting of the hearing device 1 according to the present invention, particularly a disposing position of the vibration output structure 3, will be described using the accompanying drawings. FIG. 3A and FIG. 3B are detailed views illustrating a state of wearing the working example of the hearing device according to the present invention, FIG. 4 is a view illustrating a fitting position for the working example of the hearing device according to the present invention, and FIG. 5 is a view illustrating an example of wearing the working example of the hearing device according to the present invention.

FIG. 3A is a rear view of a head of the wearer showing a state in which the hearing device 1 of the present invention is fitted to both ears. As shown in the drawing, the hearing device 1 is disposed between the back part of the auricle and the temporal region, and the vibration output structure 3 is disposed so as to be in contact with the back part of the auricle and the temporal region over the area ranging from the upper part to the lower part of the back of the auricle (shown by an arrow in the drawing).

In the present invention, the area ranging from the upper part to the lower part of the back of the auricle is not exact, and the vibration output structure 3 is formed to have a length so as to be widely in contact with an area of a part where the back of the auricle connects with the temporal region. Also, a width of the vibration output structure 3 is formed in a size that does not give pressing feeling when disposed between the back part of the auricle and the temporal region and that can conduct vibrations to the back part of the auricle and the temporal region.

FIG. 3B is a plan view of the head of the wearer, in which the hearing device 1 including the vibration output structure 3 is disposed between the back part of the auricle and the temporal region, and the vibration output structure 3 is in contact with the back part of the auricle and (the skull of) the temporal region.

As above, the hearing device 1 according to the present invention is characterized in that the vibration output structure 3 is disposed between the back part of the auricle and the temporal region and has a length that can contact the area ranging from the upper part to the lower part of the back of the auricle. In this way, the vibration output structure 3 is configured so that vibrations can be transmitted from the back part of the auricle to the entire auricle and from the temporal region to the skull, ranging widely over the area from the upper part to the lower part of the back of the auricle.

FIG. 4 is a view showing a position at which the vibration output structure 3 is disposed when the hearing device 1 is worn. The area ranging from the upper part to the lower part of the back of the auricle between the back part of the auricle and the temporal region is a position a at which the vibration output structure 3 is disposed. The hearing device 1 is configured so that, by disposing the vibration output structure 3 at the position a, a side face of the vibration output structure 3 naturally comes into contact with the back part of the auricle and the temporal region.

FIG. 5 is an example of wearing the hearing device 1 where the vibration output structure 3 is disposed at the position a. As shown in the drawing, the hearing device 1 is fitted to the back part of the auricle so that the vibration output structure 3 of the hearing device 1 comes into contact with the back part of the auricle and the temporal region. At this time, since the hearing device is configured to make the vibration output structure 3 contact with a wide area, the wearer does not have to be aware of the particular position of the back part of the auricle or the temporal region. The wearer can hear the sounds by simply hanging the ear-hanging member 4 on his/her auricle and disposing the housing 20 at the back part of the auricle without paying special attention.

Figure 6:
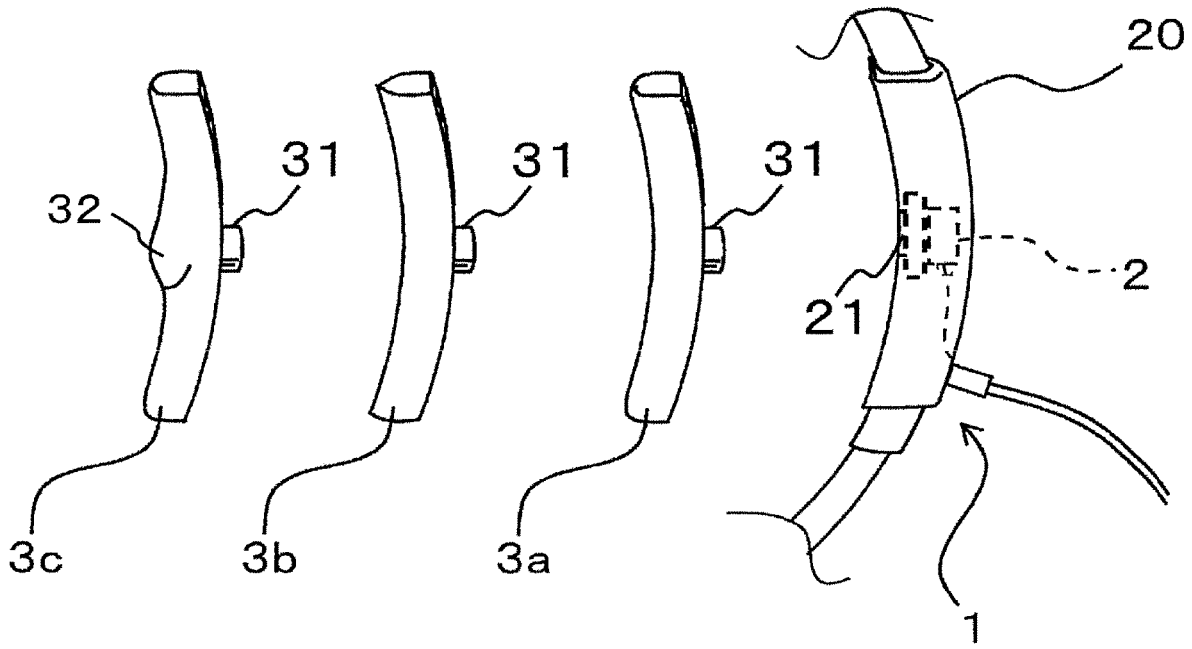
FIG. 6 is a view illustrating other examples of a vibration output structure of the working example of the hearing device according to the present invention.

Also, the vibration output structure 3 may be in a form so as to be disposed contacting the area ranging from the upper part to the lower part of the auricle between the back part of the auricle and the temporal region. Thus, any shapes of the vibration output structure 3 may be attached to the housing 20. Not limited to a shape of a vibration output structure 3*a* shown in FIG. 6, a vibration output structure 3*b* has a substantially triangular cross section so as to be easily fitted between the back part of the auricle and the temporal region, and a vibration output structure 3*c* is provided with a protruding portion 32 at a part. For example, as shown in FIG. 6, each of the vibration output structures 3*a*, 3*b*, and 3*c* is provided with a protrusion portion 31 of the same shape and the protrusion portion 31 is inserted into a recess portion 21 of the housing 20 to attach each of the vibration output structures 3*a*, 3*b*, and 3*c* to the housing 20 detachably. That is, the vibration output structure 3 that is most suitable for the user's age, sex, the shape of his/her head and ears can be chosen and attached to the housing 3.

Also, since the hearing device 1 according to the present invention is configured to conduct vibrations from the vibration output structure 3 to the area ranging from the upper part to the lower part of the auricle, the vibration output structure 3 is configured to vibrate as a whole due to the vibrations transmitted from the bone conduction drive. Thus, the bone conduction drive 2 is selected to have output power that is capable of vibrating the entire vibration output structure 3.

Also, in the hearing device 1 according to the present invention, the one that vibrates is the vibration output structure 3, and it is preferable that the housing 20 accommodating and fixing the bone conduction drive 2 does not vibrate.

Figure 7:
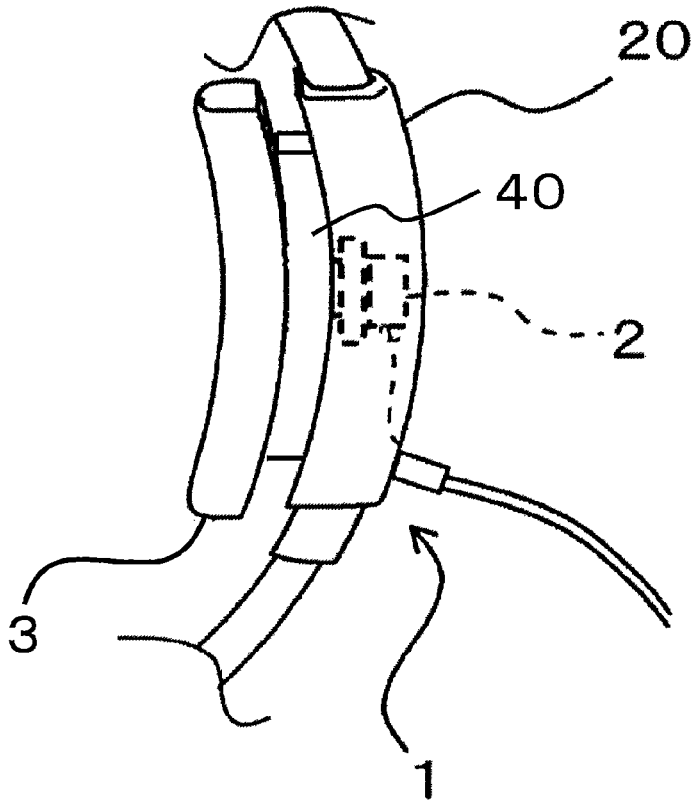
FIG. 7 is a view illustrating an example of a structure for suppressing vibration of a housing of the working example of the hearing device according to the present invention.

For example, as shown in FIG. 7, to prevent the housing 20 from vibrating, a buffer member 40 that absorbs vibrations can be disposed between the vibration output structure 3 and the housing 20.

Figure 8:
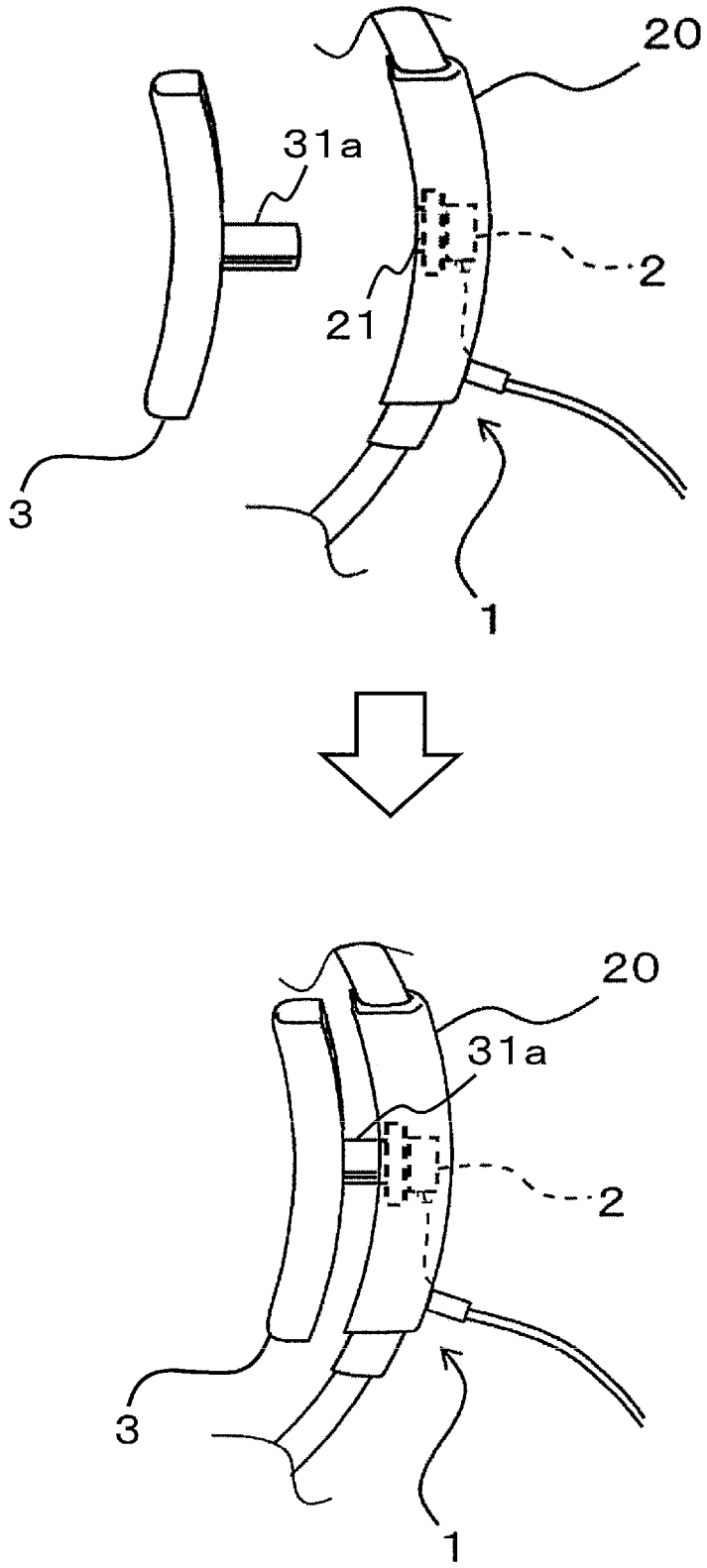
FIG. 8 is a view illustrating another example of a structure for suppressing vibration of a housing of the working example of the hearing device according to the present invention.

Also, as shown in an upper view in FIG. 8, forming a protrusion portion 31*a* of the vibration output structure 3 longer than a depth of the recess portion 21 (an insertion opening) of the housing 21 enables to inhibit both side faces of the vibration output structure 3 and the housing 21 from contacting with each other when the vibration output structure 31 is attached to the housing 3 as shown in a lower view in FIG. 8. With such a structure, vibrations transmitting from the vibration output structure 3 to the housing 21 can be suppressed compared to the case in FIG. 1 in which the entire side faces of the vibration output structure 3 and the housing 21 are in contact with each other, and thus vibrations of the housing 21 itself can be prevented.

Figure 9:
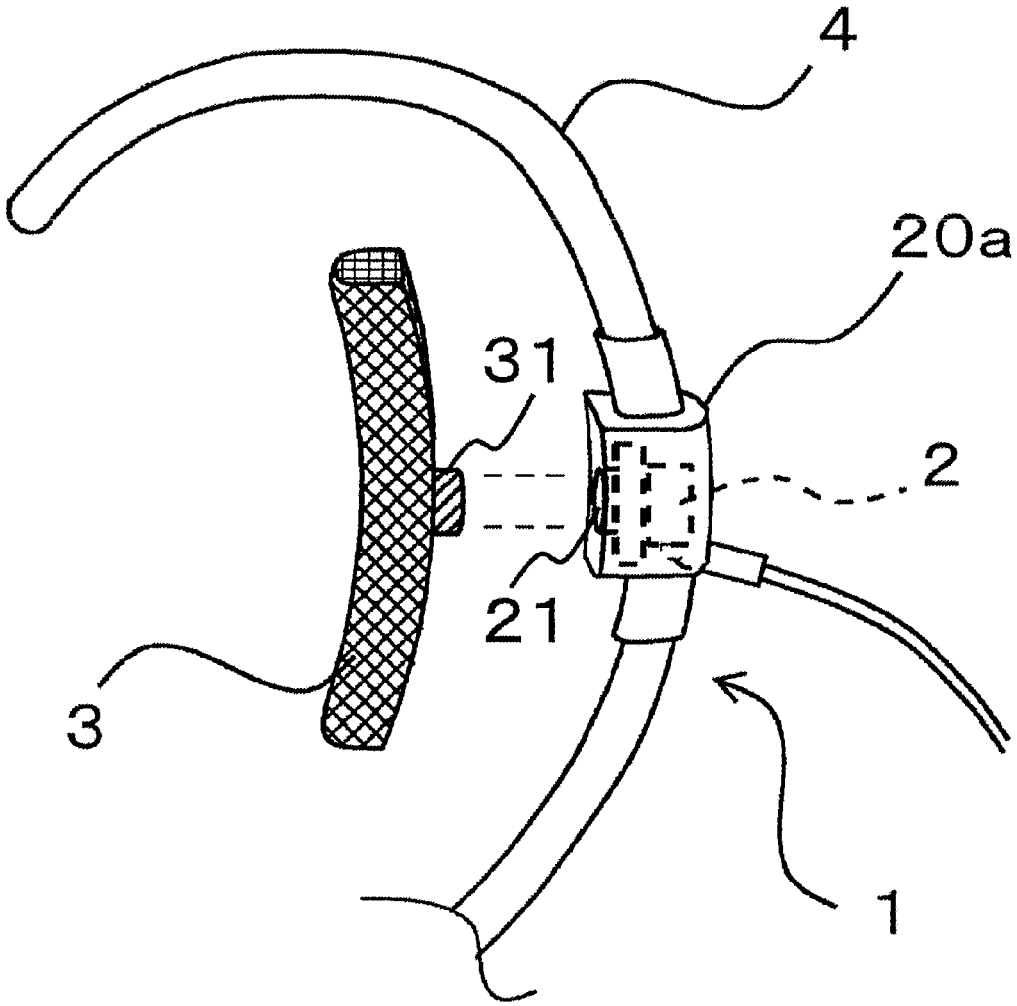
FIG. 9 is a view illustrating another example of the housing of the working example of the hearing device according to the present invention.

FIG. 9 is a view showing another example of the housing of the working example of the hearing device according to the present invention. Since the housing 20 should accommodate and fix the bone conduction drive 2, support the vibration output structure 3, and transmit vibrations stably and accurately, the housing 20 may have the same size as the vibrating output structure 3, or, alternately, a small sized housing 20*a* as shown in FIG. 9 may be used taking overall design into consideration.

Figure 10:
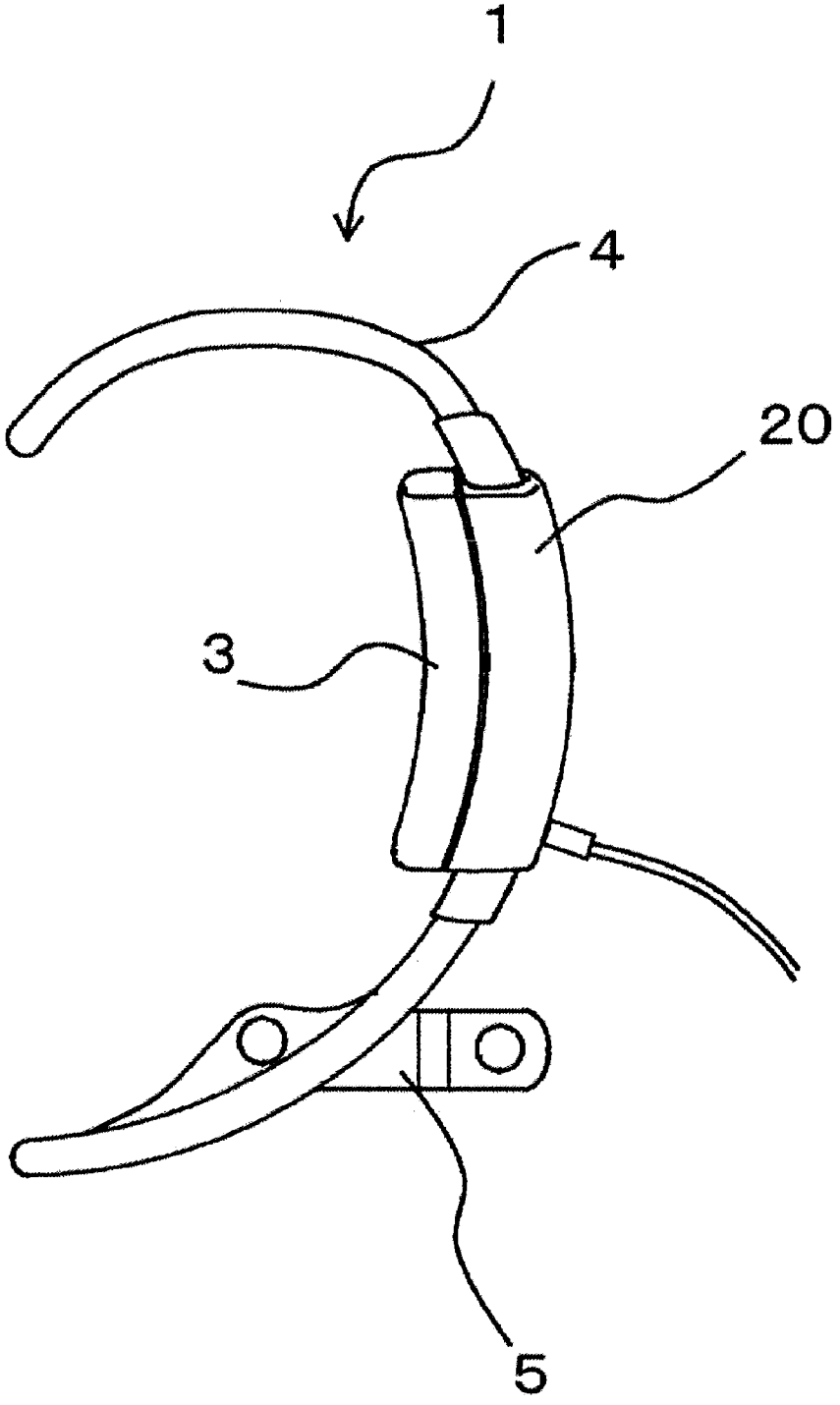
FIG. 10 is an external appearance view illustrating another working example of the hearing device according to the present invention.
Figure 11:
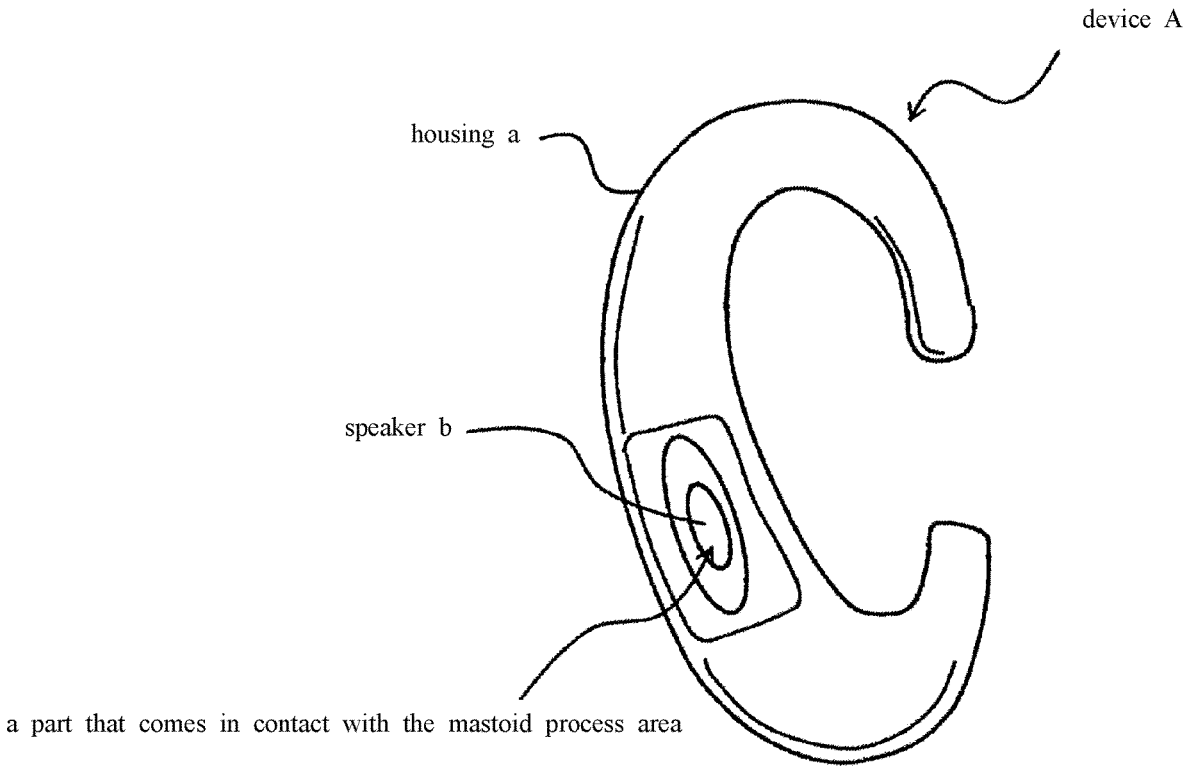
FIG. 11 is a view illustrating a prior art.

Also, the hearing device 1 according to the present invention may include a locking means for an earlobe as shown in FIG. 10, which is an external appearance view illustrating another working example of the hearing device according to the present invention.

By providing a locking means for the hearing device 1, the hearing device 1 can be worn stably and the vibration output structure 3 can be fitted properly.

The locking means shown in the drawing is a magnet type locking. However, the locking means may be in any other form, such as a clip, as long as the wearer can attach easily. The locking position may be not only the earlobe but also any positions such as an upper edge portion or side edge portion of the auricle, or an edge portion of the earhole. The locking means is not limited as long as it is easy to be attached to the locking position.

INDUSTRIAL APPLICABILITY OF THE INVENTION

The present invention relates to a hearing device employing bone conduction and is not limited to bone conduction headphones, and can be used in various devices and equipment employing bone conduction, such as hearing aids, microphones, and equipment for hearing conversations taking place in noisy places.

What is claimed is:

1. A hearing device comprising:

a bone conduction drive that converts acoustic electric signals into vibrations;

a vibration output structure that outputs the vibrations converted by the bone conduction drive; and an ear-hanging member that is provided above a housing accommodating the bone conduction drive and is hanged on an upper part of an auricle so as to dispose the vibration output structure between a back part of the auricle and a temporal region, wherein the vibration output structure is disposed between the back part of the auricle and the temporal region and has a length that comes into contact with an area ranging from an upper part to a lower part of the back of the auricle.

2. The hearing device according to claim 1, further comprising a locking means for an earlobe, the locking means being provided below the housing and enabling accurate fitting of the vibration output structure.

3. The hearing device according to claim 1, wherein the ear-hanging member is formed as detachable to the housing.

4. The hearing device according to claim 1, wherein instead of including the ear-hanging member, the housing is disposed at each end of a neckband or a headband.

5. The hearing device according to claim 1, wherein the vibration output structure vibrates without vibrating the housing.

6. The hearing device according to claim 1, wherein a buffer member that absorbs vibrations is provided between the vibration output structure and the housing.

7. The hearing device according to claim 2, wherein the ear-hanging member is formed as detachable to the housing.

8. The hearing device according to claim 2, wherein instead of including the ear-hanging member, the housing is disposed at each end of a neckband or a headband.

9. The hearing device according to claim 3, wherein instead of including the ear-hanging member, the housing is disposed at each end of a neckband or a headband.

10. The hearing device according to claim 2, wherein the vibration output structure vibrates without vibrating the housing.

11. The hearing device according to claim 3, wherein the vibration output structure vibrates without vibrating the housing.

12. The hearing device according to claim 2, wherein a buffer member that absorbs vibrations is provided between the vibration output structure and the housing.

13. The hearing device according to claim 3, wherein a buffer member that absorbs vibrations is provided between the vibration output structure and the housing.

14. The hearing device according to claim 4, wherein the vibration output structure vibrates without vibrating the housing.

15. The hearing device according to claim 4, wherein a buffer member that absorbs vibrations is provided between the vibration output structure and the housing.

16. The hearing device according to claim 5, wherein a buffer member that absorbs vibrations is provided between the vibration output structure and the housing.

* * * * *